United States Patent [19]

Shibuya et al.

[11] Patent Number: 4,466,578

[45] Date of Patent: Aug. 21, 1984

[54] WINDING MACHINE

[75] Inventors: Kiyoshi Shibuya, Chiba; Hiroshi Shimanaka, Funabashi; Yoshiaki Tanaami, Yokohama, all of Japan

[73] Assignees: Ishikawajima-Harima Jukogyo Kabushiki Kaisha; Kawasaki Seitetsu Kabushiki Kaisha, both of Japan

[21] Appl. No.: 395,624

[22] Filed: Jul. 6, 1982

[30] Foreign Application Priority Data

Jul. 8, 1981 [JP] Japan ..... 56-106612
Nov. 27, 1981 [JP] Japan ..... 56-176421

[51] Int. Cl.[3] ..... B65H 17/08; B65H 17/32; B65H 19/28

[52] U.S. Cl. ..... 242/65; 226/97; 242/67.2; 242/76

[58] Field of Search ..... 242/65, 76, 66, 67.1 R, 242/67.2; 226/97, 196, 91

[56] References Cited

U.S. PATENT DOCUMENTS

| | | | |
|---|---|---|---|
| 3,567,093 | 3/1971 | Johnson | 226/97 |
| 3,976,237 | 8/1976 | Bossons | 226/97 |
| 3,979,038 | 9/1976 | Karlsson | 226/97 |
| 4,039,256 | 8/1977 | Teeple, Jr. et al. | 226/97 X |
| 4,069,595 | 1/1978 | Ahlbert et al. | 226/97 X |
| 4,102,506 | 7/1978 | Raasch et al. | 242/65 X |
| 4,111,377 | 9/1978 | Tetro et al. | 242/65 X |
| 4,143,828 | 3/1979 | Braun et al. | 242/67.1 R X |
| 4,190,475 | 2/1980 | Marschke | 226/97 X |
| 4,305,552 | 12/1981 | Pisani | 242/67.2 |

FOREIGN PATENT DOCUMENTS

| | | | |
|---|---|---|---|
| 477092 | 2/1976 | U.S.S.R. | 242/65 |

*Primary Examiner*—Stuart S. Levy
*Assistant Examiner*—Scott J. Haugland

[57] ABSTRACT

The invention relates to a winding machine which winds a very thin metallic sheet at a high speed automatically with a winding drum pressed against a drive roll and driven by the frictional torque of the latter and air blown in a direction same with that of travel of the sheet.

3 Claims, 6 Drawing Figures

WINDING MACHINE

BACKGROUND OF THE INVENTION

Conventionally, in the case of winding a very thin metallic sheet by a winding machine, the worker had to manually lead the leading end of the sheet out to a winding drum, paste said leading end to the drum by an adhesive tape and drive the drum at a high speed to wind the sheet.

In such conventional means, an extra worker is required. Moreover, there is a possibility of the sheet being broken when it is led out to the drum. Further, in a installation with an high speed designed for the sheet leading end, it is no longer possible to wind the sheet.

As one of the conventional winding machines, a belt wrapper type winding machine is available. It permits automatic winding of the leading end of the sheet, as intended under the present invention. But, with such belt wrapper type winding machine, it is difficult to provide a high speed for the winding start of the sheet leading end (presently a speed of about 300 m/min being a limit).

Here, it is an object of the present invention to provide a winding machine which is capable of winding a very thin metallic sheet without it being broken even if a very high speed is required for winding the leading end of the sheet, said machine also being simple in construction and free from damage, permitting maintenance with ease.

The present invention will become more apparent from the following description of preferred embodiments thereof taken in conjunction with the accompanying drawings.

DETAILED DESCRIPTION OF THE PREFERRED EMBODIMENTS

Figure 1:
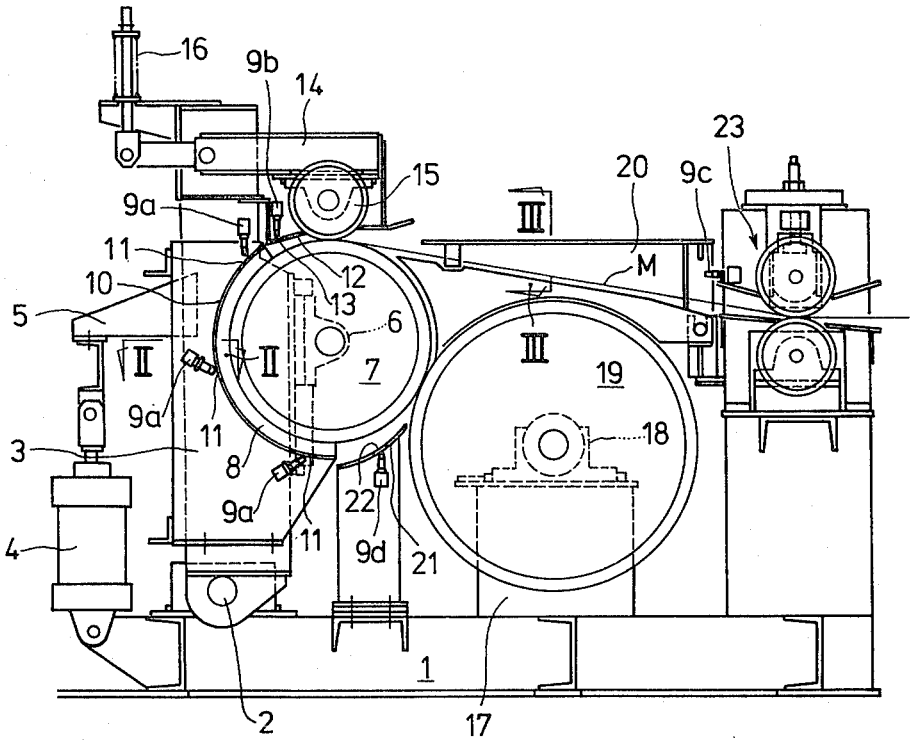
FIG. 1 is a diagram for explanation of an embodiment of the present invention.
Figure 2:
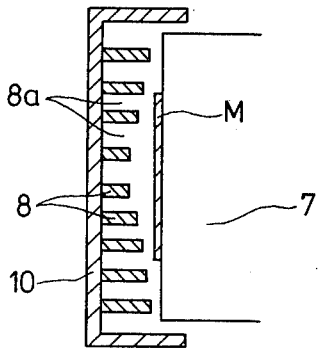
FIG. 2 is a view looking in the direction indicated by the arrows II of FIG. 1.
Figure 3:
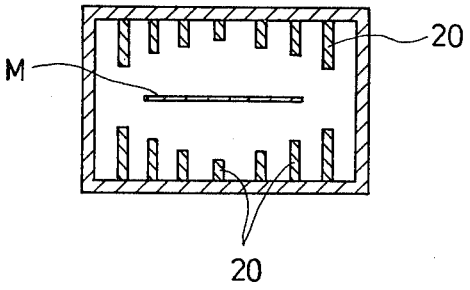
FIG. 3 is a view looking in the direction indicated by the arrows III of FIG. 1.

Referring to FIGS. 1 to 3 showing an embodiment of the present invention, a rocking frame 3 is pivoted through a pin 2 connected to a frame 1 installed on a required foundation. A fluid pressure cylinder 4 has its lower end pivoted to the frame 1 and its upper end pivoted to a bracket 5 which in turn is fixed to the rear surface of the rocking frame 3, so that the rocking frame 3 rocks to and fro in the direction of travel of a very thin metallic sheet M. An idler type winding drum 7 is rotatably pivoted to a bearing 6 mounted on the front surface of the rocking frame 3.

A number of guide plates 8 are mounted on a hollow frame 10 fixed to the rocking frame 3 and are spaced apart from one another in an axial direction of the winding drum 7 such that their height is lowest at the center and is increasing toward either side or, as a whole, in the form of a concave comb to form a groove 8*a* between the adjacent guide plates 8. Air nozzles 9*a* are mounted on the rocking frame 3 at predetermined spacing so that air spouted out of each air nozzle 9*a* is blown through a hole 11 in the frame 10 between the guide plates 8 in a direction to forward the sheet M. Air nozzles 9*b* are also provided at the upper part of the rocking frame 3 to blow air through a hole 13 formed in a guide plate 12 in a direction to forward the sheet M.

An arm 14 is pivoted to the upper part of the rocking frame 3 and has a pressing roll 15 pivoted, at its front end, and a spring 16, at its rear end. The pressing roll 15 is in parallel with the winding drum 7 and is adapted to be engaged with the latter by the spring 16 biasing the pressing roll 15 to the winding drum 7.

A support 17 is mounted on the frame 1 and has a bearing 18 which carries a drive roll 19 driven by drive means (not shown). The drive roll 19 is in parallel with the winding drum 7 which is adapted to be engaged with the former. As shown in FIG. 3, guide plates 20 are mounted along the drive roll 19 on a hollow frame which is disposed above the latter, to guide the sheet M. Air nozzles 9*c* are provided to blow air in a direction to forward the sheet M. The guide plates 20 are so arranged as to form a concave comb as a whole, and between the upper and lower series of the guide plates 20 is formed barrel-shaped space in cross-section. In the drawings, reference numeral 9*d* denotes air nozzles; 21, a guide plate; 22, a hole; and 23, pinch rolls.

Next the mode of operation will be described.

The fluid pressure cylinder 4 is actuated to bring the winding drum 7 into contact with the drive roll 19. By driving the drive roll 19, the winding drum 7 is driven by the frictional torque in a counterclockwise direction in FIG. 1, while compressed air is spouted out of the air nozzles 9*a*, 9*b*, 9*c* and 9*d*. The very thin metallic sheet M of the order of about 0.1 mm thickness is taken out of manufacturing equipment (not shown) and is passed between the pinch rolls 23 into the guide plates 20.

The sheet M fed into the guide plates 20 runs through the guides plates 20 smoothly by the jet pressure of air spouted out of the air nozzles 9*c* to be forwarded to the winding drum 7 where it turns around the winding drum 7 as it is pressed to the winding drum 7 by the pressing roll 15.

The leading end of the sheet M turns with the winding drum 7, and by the jet pressure of air from the air nozzles 9*b* and 9*c*, it passes through the guide plates 8 smoothly and, by the jet pressure of air from the air nozzles 9*b*, 9*c*, and 9*d*, is forwarded to the abutting position of the winding drum 7 on the drive roll 19. Then, being held at the abutting position, it is forwarded toward the pressing roll 15 at the entry of which winding of the first round is completed. As soon as the winding of the leading end of the sheet is completed, the air nozzles are closed, but the winding is continued.

As the sheet M wound on the winding roll 7 increases, the fluid pressure cylinder 4 is actuated to gradually withdraw the rocking frame 3 from the drive roll 19. Consequently, drive of the winding drum 7 is made across the sheet M. But, here, it is possible to control the winding tension finely by adjusting the pressure of pressing the winding drum 7 to the drive roll 19 by the fluid pressure cylinder 4.

Further, as the sheet M is wound up increasingly, the pressing roll 15 is pushed up. But, as it is pressed to the winding drum 7 under a substantially constant pressure by the spring 16, winding of the sheet M is carried out without difficulty. The pressing roll 15 serves to prevent zig-zag movement of the sheet being wound.

Still further, if the speed of revolution of the drive roll 19 is tuned to the speed of forwarding the sheet M, it is not necessary to change the speed of the drive means with increase of the winding as the outer periphery of the wound of sheet is in contact with the drive roll 19.

The guide plates 8 or 20 shown in FIGS. 2 or 3 are adapted to laminate the air flow from the air nozzles 9*a* and 9*c* and thus enable, together with the straight air flow, to wind the leading end of the sheet onto the winding drum 7 without meandering.

When the guide plates 8 or 20 have the height arranged as shown in FIGS. 2 or 3, it is possible to obtain greater speed of air flow at each side of the sheet and smaller speed at the center thereof for further improvement of the function to prevent zig-zag movement of the leading end of the sheet at the time of winding.

In this embodiment, however, it takes troublesome work and much time to change the winding drum 7 as the arm 14 has to be removed together with the pressing roll 15 and the winding drum 7 has to be carried on some support before it is removed from the rocking frame 3.

Figure 4:
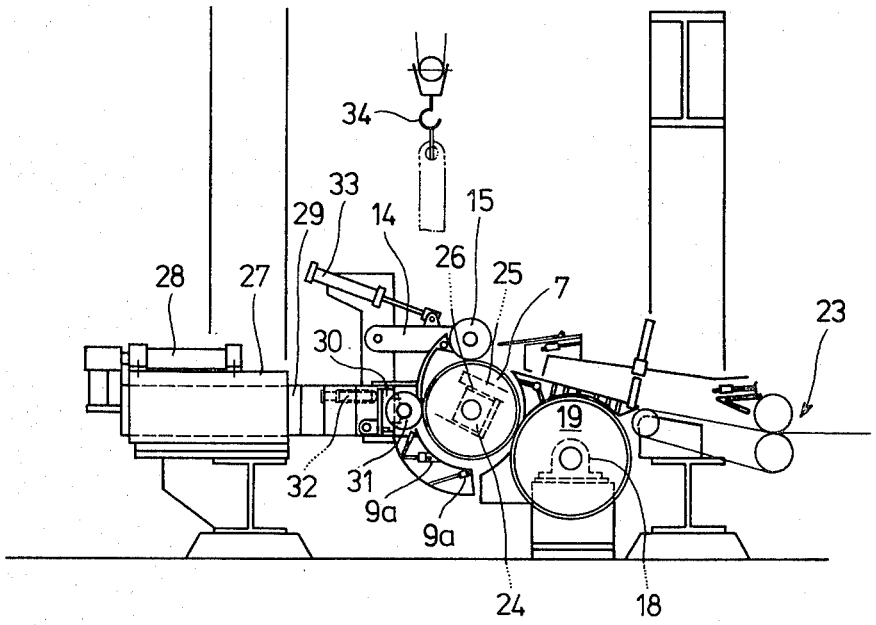
FIG. 4 is a diagram for explanation of another embodiment of the present invention.

FIG. 4 shows another embodiment of the invention which permits change of the winding drum 7 with ease.

A frame 25 is disposed on a required foundation to support a drum chock 24 in such a manner that a groove 26 adapted to fit the drum chock 24 is sloped down toward the drive roll 19. The winding drum 7 is so disposed as to be supported by the drum chock 24.

At a required position before the winding drum 7, a guide frame 27 is provided to fittedly receive a slide frame 29 which is adapted to slide toward the winding drum 7. At the extreme end, on the winding drum 7 side, of said slide frame 29 is pivoted a bracket 30 on which a pressing roll 31 is mounted in parallel to the winding drum 7. Further, a spring 32 is provided to bias said pressing roll 31 so that the pressing roll 31 presses the surface of the winding drum 7 and thus the winding roll 7 does not chatter during the winding work, while the pressing roll 15 pivoted on the arm 14 is pressed against the winding drum 7 by a fluid pressure cylinder 33. In the drawings, reference numeral 34 represents a crane hook for change of the idle drum, and the same numerals as those in Fig. 1 show the same parts.

The work of winding the very thin metallic sheet M is initiated as the slide frame 29 is moved toward the winding drum 7 by the fluid pressure cylinder 28 so that the winding drum 7 is pressed to the drive roll 19 by the pressing roll 31 while the pressing roll 15 is pressed to the winding drum 7 by the fluid pressure cylinder 33. As the sheet M is wound on the winding drum 7 increasingly, the winding drum 7 moves up along the groove 31, the pressing roll 31 being caused to move back by the fluid pressure cylinder 28, and the pressing roll 15 being caused to move up by the fluid pressure cylinder 33.

To change the winding drum 7, the arm 14 is raised by the fluid pressure clinder 33 to separate the pressing roll 15 from the winding drum 7, and the slide frame 29 is withdrawn, together with the pressing rolls 15 and 31, by the fluid pressure cylinder 28 to a remotest position from the winding drum 7. Then, by a jig or the like suspended from the crane hook 34, the drum chock 24 is moved, together with the winding drum 7, up slidably along the groove 26. When the drum chock 24 comes off the groove 26 completely, the crane hook 34 is raised and caused to transport the winding drum 7 to any other place.

Figure 5:
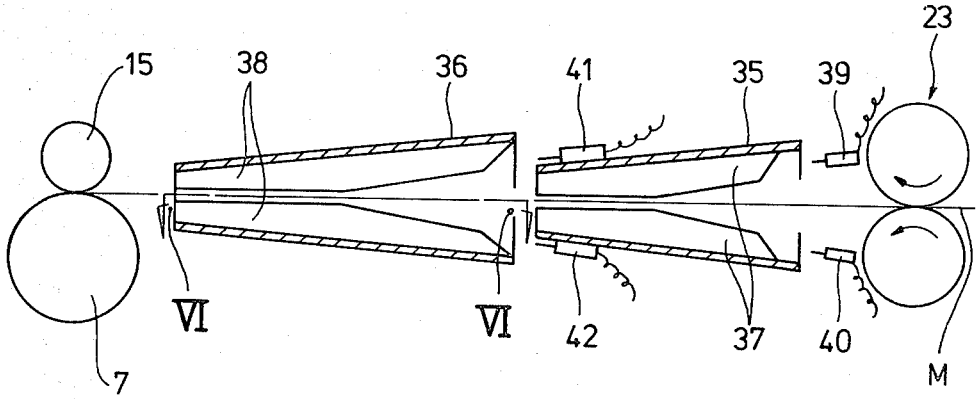
FIG. 5 is a diagram for explanation of a modification of a sheet guide used in the present invention.
Figure 6:
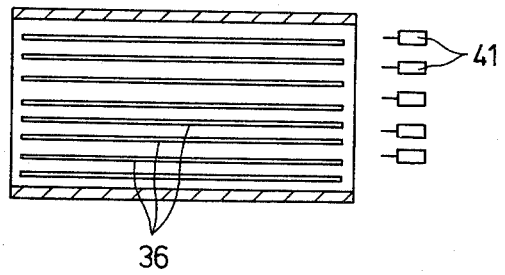
FiG. 6 is a view looking in the direction indicated by the arrows VI of FIG. 5.

FIGS. 5 and 6 show a modification of the guide means used in the present invention. As seen, a required number of guide frames 35 and 36 are disposed between the pinch rolls 23 on the one hand and the winding drum 7 and pressing roll 15 on the other hand in the transport line of the very thin metallic sheet M, said guide frames 35 and 36 having upper and lower surfaces sloped respectively so that the cross-sectional area of the hollow part in the upstream side is greater than that in the lower stream side. Guide plates 37 and 38 are fixed on the upper and lower surfaces of the guide frames 35 and 36 respectively so as to stand against each other. These guide plates 37 or 38 are disposed longitudinally in the direction parallel to the direction of travel of the sheet and, when seen cross-sectionally, in the form of a comb of higher teeth towards the ends and lower teeth around the center, as that shown in FIG. 3, to form a barrel-shaped space in cross-section between the upper and lower guide plates 37 or 38.

The guide frames 35 and 36 have air nozzles 39, 40 and 41, 42 on the upstream side respectively so that compressed air is blown into the guide frames 35 and 36, these air nozzles being so designed that the velocity of air blown out of the upper air nozzles 39 or 41 is higher than that of air blown out of the lower nozzles 40 or 42.

The mode of operation of this device will now be described.

The very thin metallic sheet M fed from the pinch rolls 23 is conveyed through the guide frame 35 toward the lower side with its leading end kept straight by the high speed air flows blown out of the air nozzles 39 and 40, and coming out of the guide frame 35, it is conveyed through the guide frame 36 toward the lower side with its leading end kept straight by the high speed air flows blown out of the air nozzles 41 and 42. Then, it is wound by the winding drum 7.

By the differential pressure produced by the difference in velocity between the air flows over and beneath the sheet to be conveyed, a buoyancy is always produced in the sheet to be conveyed so that the sheet is fed to the lower side under the floated condition as in the case shown in FIG. 3. Further, the high speed air flows out of the air nozzles 39, 40, 41 and 42 are rectified by the guide plates 37 and 38 into laminar flows but not turbulent flows so that the sheet M is conveyed straightly without meandering. Thus, conveyance of the sheet M is effected in a smooth manner. Further, the guides plates 37 and 38 are arranged in a concave form respectively so that they serve as an ancillary (mechanical) guide if the sheet should make a zig-zag movement.

It should be understood that the present invention is not limited to the embodiments described above but allows various modifications such as driving the pressing roll so far as they will not deviate from the spirit of the present invention.

With the foregoing construction of the winding machine of the present invention, the following distinguished effects are provided.

(I) Low cost and easy maintenance are obtained on account of simple construction.

(II) Economy of labor is obtained with no man power required for introduction of the very thin metallic sheet at the start of winding, insuring fully automatic winding.

(III) Motor of only constant speed is required for revolution of the drive roll, with no speed control required for increasing diameter of the sheet on the winding roll.

(IV) Refined winding tension control is enabled by adjusting the pressure of pressing the winding drum so that motor torque control is not required, resulting in less breakage of the sheet in winding operation.

(V) With guide plates on the outer periphery of the winding drum, meandering is prevented of the leading end of the sheet at the time of winding.

(VI) High efficiency of the work is obtained with simple equipment, because the sheet is glidably conveyed so that it is transported smoothly and exactly at a high speed free from damage and thus it is no longer required to stop the line.

What is claimed is:

1. A winding machine comprising a rotatable winding drum which is movable in a direction parallel to a direction of movement of a very thin metallic sheet, a drive roll for rotating the winding drum by a frictional force, characterized by first and second hollow frames each having guide plates for the sheet in the form of a concave comb facing said sheet and disposed transversely with respect to the direction of movement of said sheet, said plates being disposed so that their longitudinal direction is in parallel to the direction of movement of the sheet, and air nozzles for blowing of air into the hollow frames in the same direction as the direction of movement of the sheet, whereby the speed of air flow at each side of the sheet is greater than the air flow at the central portion thereof.

2. A winding machine as set forth in claim 1 wherein said second hollow frame has upper and lower surfaces, at least one of said surfaces of said second hollow frame being sloped from the upstream side to the downstream side, and the cross-sectional area of the second hollow frame at the downstream side is made smaller than that at the upstream side.

3. A winding machine as set forth in claim 2 wherein the air nozzles are provided at upper and lower parts on the upstream side of the second hollow frame to blow air into said second hollow frame, and a velocity of air flow from the upper air nozzles is greater than that of the lower air nozzles.

* * * * *